US007866935B1

(12) United States Patent
Wilt et al.

(10) Patent No.: US 7,866,935 B1
(45) Date of Patent: Jan. 11, 2011

(54) MANUALLY OPERATED COUPLER

(75) Inventors: Albert T. Wilt, Ooltewah, TN (US); Trace Errera, Chattanoga, TN (US); Alan Graham, Ooltewah, TN (US); Al Kimble, Rock Spring, GA (US)

(73) Assignee: TAG Manufacturing, Inc., Chattanooga, TN (US)

( * ) Notice: Subject to any disclaimer, the term of this patent is extended or adjusted under 35 U.S.C. 154(b) by 183 days.

(21) Appl. No.: 12/332,921

(22) Filed: Dec. 11, 2008

(51) Int. Cl.
*E02F 3/28* (2006.01)

(52) U.S. Cl. ..... 414/723; 37/468; 403/321

(58) Field of Classification Search ..... 414/723; 37/468; 403/321
See application file for complete search history.

(56) References Cited

U.S. PATENT DOCUMENTS 4,462,172 A * 7/1984 Caron ..... 37/231
5,791,863 A * 8/1998 Droegemueller ..... 414/723
5,966,850 A * 10/1999 Horton ..... 37/468
6,499,934 B1 * 12/2002 Kaczmarski et al. ..... 414/723

* cited by examiner

*Primary Examiner*—Donald Underwood
(74) *Attorney, Agent, or Firm*—Stephen J. Stark; Miller & Martin PLLC

(57) ABSTRACT

A coupler for use with an excavator provides a hook with a mouth which receives a cross bar of an implement such as a bucket at an upper end. Towards a bottom end the coupler receives an extension through an opening. The extension is then retained by a pin through a bore in the extension and a bore in a body of the coupler. The mouth of the hook is provided with at least one wear pad which preferably extends along a substantial width of the mouth and is provided with adjustment members which can extend the wear pad into the mouth incrementally and/or to be tensioned against a cross bar with a selected amount of tension.

19 Claims, 3 Drawing Sheets

MANUALLY OPERATED COUPLER

FIELD OF THE INVENTION

The present invention relates to a coupler for use with earthmoving equipment, and more particularly, to manually operated couplers for use with attachments such as buckets with improved long term performance capabilities.

DESCRIPTION OF RELATED ART

Many companies provide excavators whether they be mini-excavators operated on a skid steer platform, larger earthmoving equipment such as backhoes, front end loaders, and other articulating arm earth moving equipment. Normally when this equipment is provided from the manufacturer, it may have one attachment or none as originally provided. In order to enable the equipment to work with implements such as buckets, rakes, forks, booms or other implements, a variety of companies have endeavored to provide couplers to the marketplace. Wain-Roy, Inc., initially provided one such coupler and bucket system as shown and described in U.S. Pat. No. 3,943,731 which provided for a pin locking system at a rear end of a bucket after a hook grabs a cross bar located towards an upper portion of the bucket. This type of connection system has been widely adopted throughout the industry.

However, one problem repeatedly reported to the applicant is that over time the hook to cross pipe connection wears the diameter of the cross pipe to become smaller and/or the mouth of the hook becomes larger. As one can imagine from this style construction, the bucket may then rattle and/or flop during use with the looser hook to cross pipe connection which has been found to annoy some operators.

FIELD OF THE INVENTION

It is a present object of the present invention to provide an improved connection of a cross pipe to a hook with a pin lock style coupler.

It is another object of the present invention to provide an improved coupler.

It is another object of the present invention to provide an improved coupler having at least one wear pad adjustable relative to a cross bar once installed for selective wear on wear surfaces.

Accordingly, the presently preferred embodiment of the present invention provides a coupler which may be fastened to an articulated arm linkage of an excavator and the like for connecting with implements such as to a bucket or other work implement. The coupler is provided with a hook with a mouth which permits entry of a cross bar connected to the work implement. The coupler is also configured to receive an extension of the work implement through the rear of the work implement through which a pin can then be inserted through a receiver in the coupler and through a bore in the extension thereby securing the work implement to the coupler.

In the mouth of the hook is preferably provided a laterally extending wear member which preferably extends substantially the width of the mouth and is selectively positionably adjustable relative the cross bar. In a preferred embodiment, the wear pad wears prior to portions of the mouth. Furthermore, as wear may occur either in the mouth, on the wear pad or on the cross bar, the adjustment mechanism allows for the wear pad to be extended into the mouth in a controlled manner so that either a desired torque can be placed on the cross bar which can be selected by the operator or the gap selectively diminished or increased between the wear pad and cross bar with the hook connected to the cross bar.

Furthermore, in the preferred embodiment, a significant portion of the coupler is preferably cast as a body which has been found to provide a hook member which can then be utilized with various ear constructions which may cooperate with the various manufacturer's excavator equipment having various pin connection systems.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
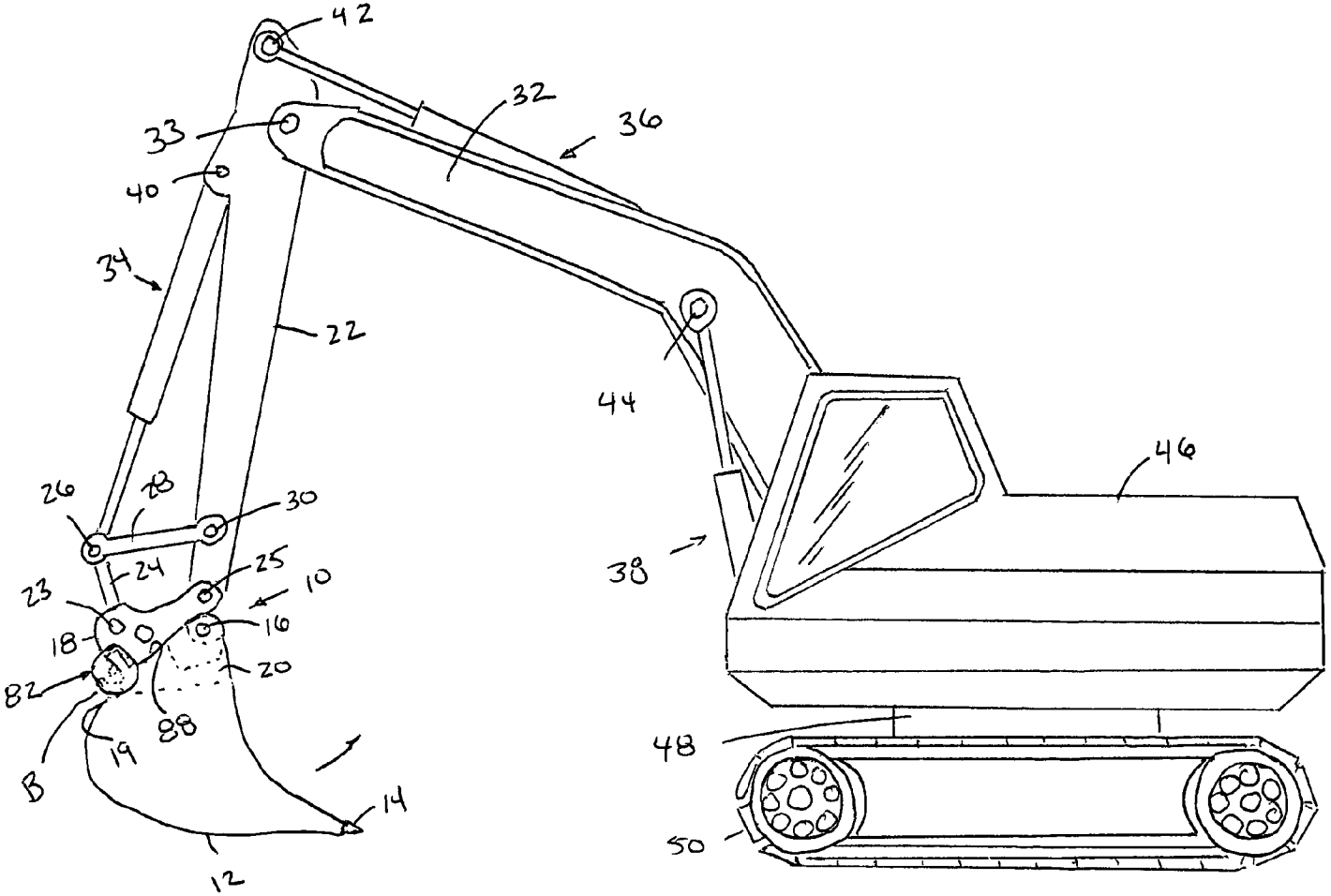
FIG. 1 is a side elevational view of an earth moving equipment apparatus having a boom including an articulating arm in which a bucket is attached by means of a coupler constructed in accordance with the principles of the present invention.

Referring now to the drawings, a coupler 10 constructed in accordance with a presently preferred embodiment of the present invention is utilized as attached to the excavator implement illustrated as bucket 12. Excavator implements such as those having teeth-like prongs 14, only one of which is illustrated may be utilized. The bucket 12 is connected by cross bar 16 and end extension 18 partially shown in phantom in FIG. 1. Cross bar 16 extends across bucket mounting plates 20, only one of which is illustrated (which may be integral to the bucket which spaces cross bar sufficiently to receive a hook from a coupler as will be described below. Normally the cross bar is at a rear and upper portion of the bucket 12 as illustrated). End extension 18 illustrated in phantom is attached normally at a rear and lower portion of bucket 12. The extension 18 is normally integral to the bucket 12 as is the cross bar 16 and mounting plates 20. Coupling 10 connects the bucket 12 to the articulating arm 22. Articulating links 24 is disposed intermediate to plates 20 with the coupler 10 being secured to pins 23 and 25 respectively when installed as illustrated.

The articulating links 24 are illustrated connected by a journal pin to one end of a second pair of respective links 28 having second ends connected to the articulating arm 22 by a journal pin 30 spaced above the bucket 12. The articulating arm 22 comprises a portion of the boom assembly of the excavator, the assembly also including a lift arm 32 to which the articulating arm is pivotally journaled and pinned at 33, and three hydraulic piston-cylinder assemblies 34,36 and 38. The rod end of the assembly 34 is pivotally journaled on the pin 26 intermediate the links 28 and has the cylinder end pivotally connected to the articulating arm 22 by a journal pin 40. The assembly 36 has its rod end pivotally journaled to the articulating arm 22 and its cylinder end journaled to the lift arm 32, while the assembly 38 has its rod end pivotally journaled to the lift arm 32 by a pivot pin 44 and its cylinder end journaled to the cab 46 of the excavator vehicle which may rotate about a base 48 relative to tractor tracks 50, wheels, etc. The excavator, of course, may be any type of such earthmoving equipment including a backhoe, skid steer, etc.

Figure 2:
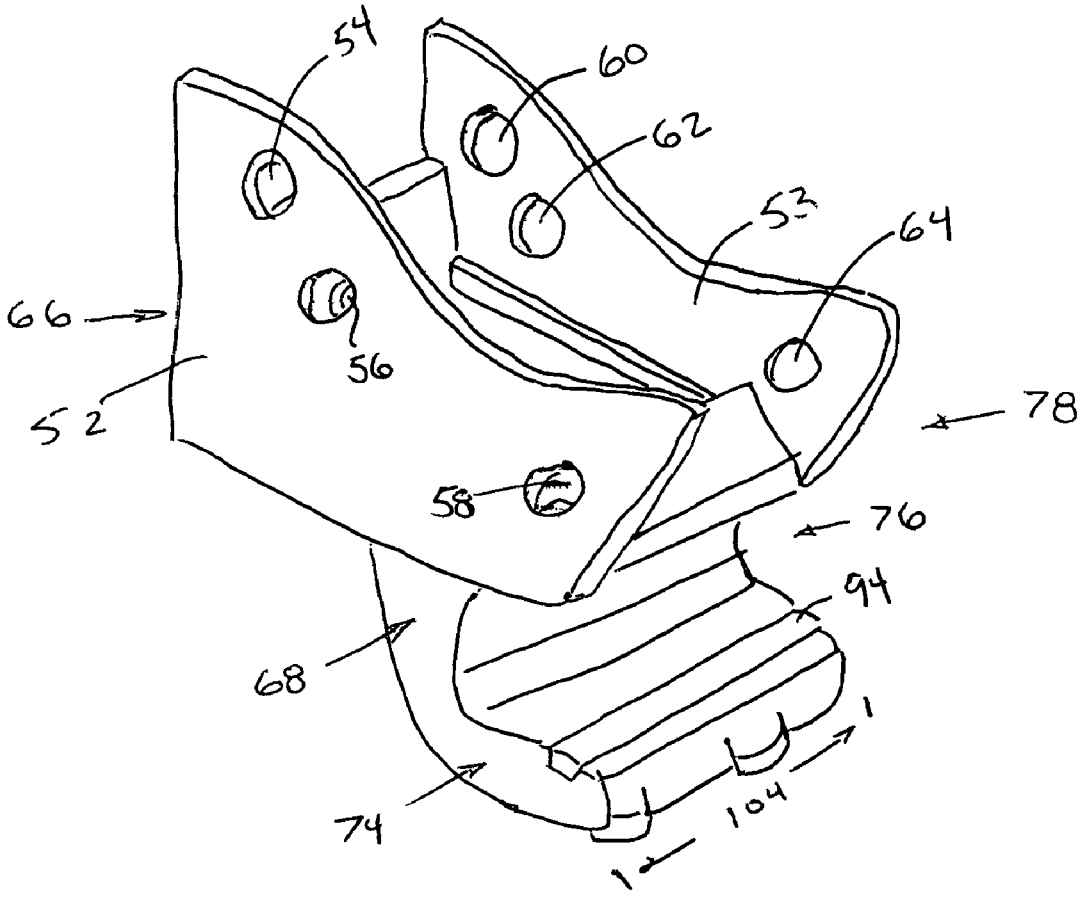
FIG. 2 is a top perspective view of the coupler shown in FIG. 1 disconnected from the excavator and the bucket.
Figure 3:
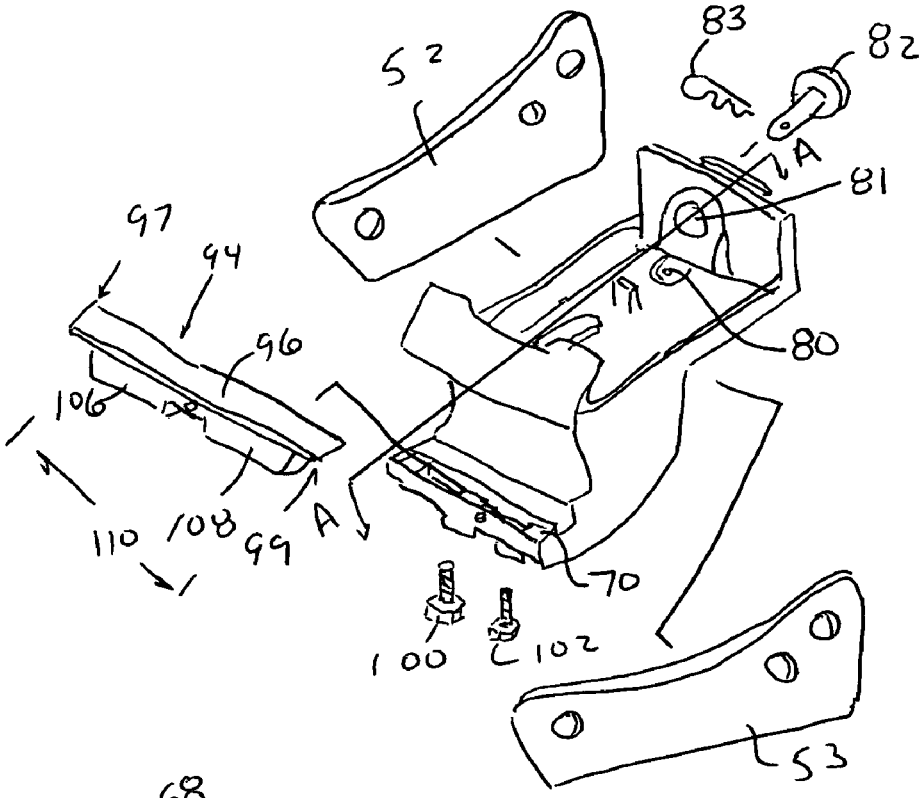
FIG. 3 shows an exploded view of the coupler shown in FIG. 2 with the ears removed and the wear pad removed from the body of the coupler.

As illustrated in FIG. 2, the coupler 10 is provided with upwardly extending and opposing ears 53,54 also called hangers which are provided to cooperate with pins 23,25 of a particular piece of earthmoving equipment such as the excavator illustrated in FIG. 1. It will be understood by those skilled in the art that excavators as shown and described herewith include mini-excavators such as skid steers based on skid steer frames, backhoes, tractors, loaders and the like having an articulated arm with which a coupler is connected to an implement such as a bucket, etc.

Bores 54,56,58,60,62,64 are useful to connect to the specific pins 23,25 of the particular excavation equipment utilized at the articulating arm 22 in the articulating link 24. Although two sets of opposing bores 54,56 and 60,62 are shown disposed toward first or bottom end 66, it is illustrated as ordinary skill in the art that only one set of opposing bores such as 54,60 may be provided in some embodiments at that end 66. Bores 62,64 are disposed toward second or upper end 78. The bore positioning is selected based upon the particular link positions established by the excavator manufacturer to receive pins such as pins 23,25.

Ears 52,53 are preferably welded to body 68 which may be cast, formed up or otherwise provided. Casting of the body 68 to have a hook 74 and receiver 81 has been found particularly desirable at least in some embodiments and possibly provide a standard body which can be matched with appropriate ears 52,53 to increase strength. Casting is also preferable in many instances to precisely locate bores 71 as will be discussed in further detail below. Body 68 preferably provides hook 74 which has a mouth 76 for receiving cross bar 16 as shown in FIG. 1. The hook 74 is normally disposed towards an upper end 78 of a connector 10 so that the operator can direct the mouth 76 under the pin 16 as illustrated in FIG. 1 and then direct the lower end 66 over extension 18 which is received through opening 80. Cross bar 16 extends the width of the mouth 72 and beyond in the preferred embodiment. Extension 18 has a bore 19 therethrough and once the extension 18 is through the opening 80, locking pin 82 can be directed through the bore 19 illustrated in phantom in FIG. 1 and cooperate with at least a portion of receiver 81 (such as being received in a bore therein or therethrough as illustrated when installed) so that locking pin 82 can then secure the implement such as bucket 12 to the coupler 10 as is illustrated in FIG. 1. Retaining pin 83 can be used to lock locking pin 81 in place.

Figure 4:
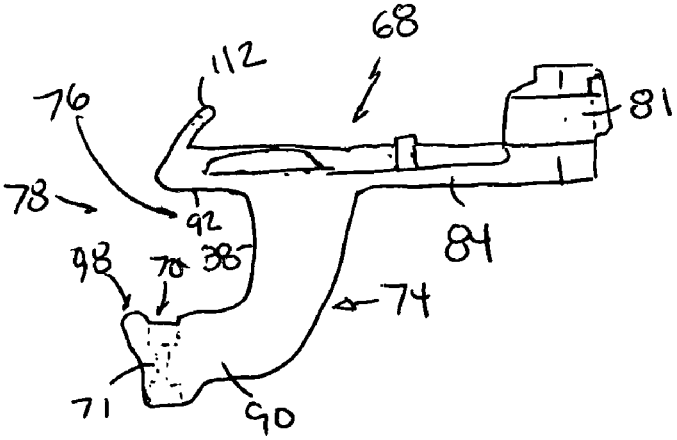
FIG. 4 shows a cross-sectional view taken along the line A-A of the body of the coupler shown in FIG. 3.
Figure 5:
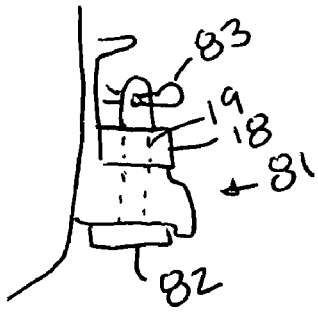
FIG. 5 shows a plan view of detail B shown in phantom in FIG. 1.

Body 68 may be better understood with reference to FIG. 4. Front face 84 may contact rear wall 88 of bucket when installed in the presently preferred embodiment. From rear face of base 16 extends hook 74 forming mouth 76. Hook has lateral member 88 and upwardly extending member 90 cooperates with shoulder 92 and lateral member 88 to form the mouth 76. Mouth 76 preferably is somewhat C-shaped in the illustrated embodiment but can take various other configurations in other embodiments. As a portion of upwardly extending member 90, a slot 70 is preferably laterally provided into which wear pad 94 is preferably provided at least partially therein as is shown in FIG. 2. In fact, front face 96 of wear pad 94 may initially be provided somewhat coplanarly with internal face 98 of upwardly extending member 90 directed in the mouth 76. Once a cross bar 16 is grasped and if there is any play (i.e., rattling, etc.) an operator can adjust wear pad 94 by tightening one of adjustment mechanisms 100,102 which are illustrated as hex screws operably coupled to push the wear pad 94 into contact with the cross bar 16 with threaded members used as adjustment mechanisms 100,102. Adjustment may be incremental and/or may also be utilized to provide a desired amount of torque. Threaded members can cooperate with threaded bores 71 at least in some embodiments and rotation of the mechanisms 100,102 can move the wear pad 94 along an axis of the bore 71 and threaded connector serving as the mechanism 100 or 102.

As illustrated in FIG. 2, wear pad 94 preferably extends laterally at least half of the width 104 of mouth 76 and in a preferred embodiment, wear pad 94 extends substantially if not the width of the mouth 76 as measured between the ears 52,53. Furthermore, adjustment mechanisms 100,102 are preferably laterally spaced from one another along the width 104 and contact respective protrusions 106,108 which extend rearwardly from face 16 and flats 97,99 so that the wear pad 94 may act along its length 110 as the connectors 100,102 push the protrusions 106,108 and thus the face 96 into the mouth 76 against or at least towards cross bar 16. By providing threaded connectors 100,102, this adjustment can be selectively incremental. Once the cross bar 16 is touched, a desired amount of force may be selected such as by providing a torque wrench to provide a desired amount of tension once installed.

Although the wear pad 94 is illustrated as being provided on the upwardly extending member forming the mouth 76, it would be understood by those of ordinary skill in the art that the wear pad 94 could also be provided on the shoulder 92 and/or elsewhere in other embodiments.

The lip 112 illustrated in FIG. 4 extending away from mouth 76 may be utilized to assist in guiding the coupler onto the connector pin 16 at least in some embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A coupler for use with an excavator having an articulating arm with a first pin and an articulating link with a second pin, and an implement having a cross bar located toward a rear and upper end of the implement and a cantilevered extension at a rear and lower end of the implement, said coupler comprising:

a pair of upwardly extending ears, said ears having first opposing bores disposed towards a first end of the ears, and second opposing bores disposed towards a second end of the ears, said first bores receiving the first pin and said second bores receiving the second pin;

a body connected to the ears, said body having a hook towards a first end of the base and a receiver towards a second end, said hook having a mouth defined at least in part by a shoulder, a lateral member and an upwardly extending member, said mouth having a slot, and said receiver cooperating with the extension and a removable pin extending through the receiver and the extension to secure the receiver to the extension when the implement is connected to the coupler with the cross bar at least partially in the mouth; and a wear pad at least partially disposed in the slot and providing a face directed into the mouth of the hook from the slot; and at least one adjustment mechanism operably coupled to the wear pad wherein manual operation of the adjustment mechanism incrementally moves at least a portion of the face into the mouth from the slot in a direction towards the cross bar when installed.

2. The coupler of claim 1 wherein the removable pin is at least partially retained in position when installed by a retaining pin extending through a base on the removable pin.

3. The coupler of claim 1 wherein the slot is laterally disposed along the upwardly extending member of the hook.

4. The coupler of claim 3 wherein the slot extends at least half of a width measured laterally between the ears in the mouth.

5. The coupler of claim 4 wherein the wear pad extends at least half of a width of the mouth between the ears.

6. The coupler of claim 1 further comprising at least two adjustment mechanisms laterally spaced along a width of the slot as defined intermediate the ears.

7. The coupler of claim 6 wherein the adjustment mechanisms further comprise at least one bore through a portion of the hook, said bore tapped to receive threaded connectors therethough, and rotation of the threaded connectors relative to the bore moves the threaded connector against the wear pad along an axis of the threaded connector.

8. The coupler of claim 7 further comprising at least two bores laterally spaced along a width of the slot as defined intermediate the ears with corresponding cooperating threaded bores.

9. The coupler of claim 8 wherein the at least two bores extend through the upwardly extending member and the threaded bores are manually operated opposite with an operator oppositely from the slot on the upwardly extending member.

10. The coupler of claim 1 further comprising an opening in the body, said opening receiving the cantilevered extension of the implement in an installed configuration.

11. The coupler of claim 1 wherein the slot extends at least substantially a lateral width of the mouth as defined between the ears.

12. The coupler of claim 11 wherein the wear pad extends at least substantially the lateral width of the mouth.

13. The coupler of claim 1 wherein the wear pad provides at least one protrusion intermediate flats which is received in the slot, and the adjustment member contacts the protrusion.

14. The coupler of claim 1 wherein the body is cast and the ears connected thereto, with the cast body including the hook and receiver.

15. The coupler of claim 14 wherein the receiver has a bore which cooperates with a bore in the extension and the removable pin when in the installed configuration.

16. The coupler of claim 1 in combination with an implement.

17. The couple combination of claim 16 wherein the implement is a bucket.

18. The coupler combination of claim 17 in combination with an excavator.

19. The coupler of claim 1 wherein the adjustment mechanism is manually operated externally relative to the mouth.

* * * * *